United States Patent [19]

Scott et al.

[11] Patent Number: 4,975,243

[45] Date of Patent: Dec. 4, 1990

[54] ALUMINUM ALLOY SUITABLE FOR PISTONS

[75] Inventors: Gerald D. Scott, Massena, N.Y.; Barrie S. Shabel, Murrysville, Pa.; Anthony Morales, Bettendorf, Iowa

[73] Assignee: Aluminum Company of America, Pittsburgh, Pa.

[21] Appl. No.: 309,112

[22] Filed: Feb. 13, 1989

[51] Int. Cl.[5] ..... C22C 21/00

[52] U.S. Cl. ..... 420/534; 148/438; 148/439; 420/535; 420/537

[58] Field of Search ..... 420/534, 535, 537; 148/438, 439

[56] References Cited

U.S. PATENT DOCUMENTS

| | | | |
|---|---|---|---|
| 3,333,955 | 8/1967 | Walker et al. | 148/438 |
| 3,716,355 | 2/1973 | Wikle et al. | 75/142 |
| 4,297,976 | 11/1981 | Bruni et al. | 123/193 |
| 4,648,918 | 3/1987 | Asano et al. | 148/439 |
| 4,681,736 | 7/1987 | Kersker et al. | 420/537 |

FOREIGN PATENT DOCUMENTS

| | | |
|---|---|---|
| 60-057497 | 12/1985 | Japan . |
| 61-051616 | 11/1986 | Japan . |
| 62-142741 | 6/1987 | Japan . |
| 62-185857 | 8/1987 | Japan . |

OTHER PUBLICATIONS

"Effects of Nickel on Hot Hardness of Aluminum-Silicon Alloys", Modern Castings, Oct. 1963, 514-520.

"Casting Alloy of the Al-Si-Cu-Ni System", V. T. Saikin, Metal Science and Heat Treatment, vol. 19, No. 9-10, Sep./Oct. 1977.

*Primary Examiner*—R. Dean

*Attorney, Agent, or Firm*—Andrew Alexander

[57] ABSTRACT

Disclosed is an aluminum alloy suitable for high temperature applications comprised of at least 9.0 wt. % Si, 3.0 to 7.0 wt. % Ni, 1.5 to 6.0 wt. % Cu, at least one of the elements selected from Mg, Mn, V, Sc, Fe, Ti, Sr, Zn, B and Cr, the remainder aluminum and impurities.

40 Claims, No Drawings

ALUMINUM ALLOY SUITABLE FOR PISTONS

BACKGROUND OF THE INVENTION

This invention relates to aluminum alloys and more particularly it relates to aluminum alloys suitable for high temperature applications such as pistons and other internal combustion engine applications.

In the use of aluminum for pistons, several alloys have been proposed. For example, J. E. Hanafee in a paper entitled "Effect of Nickel on Hot Hardness of Aluminum-Silicon Alloys", *Modern Castings,* Oct. 1963, proposes hypoeutectic and hypereutectic alloys. Under hypereutectic Hanafee suggests an alloy consisting of, in wt. %, 4.70 Ni, 10.2 Si, 1.12 Cu, 1.16 Mg, 0.53 Fe, 0.18 Ti, the balance aluminum. Hanafee suggests that the addition of Ni to a more complex alloy might be expected to improve room temperature and elevated temperature hardness by increasing the volume of stable hard particles. However, he noted that upon heating to 600° F., the alloys underwent an initial rapid decrease in hardness and then, depending on the Ni content, maintained that hardness for up to 5 hours at temperature. In addition, Kersker et al (U.S. Pat. No. 4,681,736) disclose an aluminum alloy consisting essentially of about the following percentages of materials: Si=14 to 18, Fe=0.4 to 2, Cu=4 to 6, Mg=up to 1, Ni=4.5 to 10, P=0.001 to 0.1 (recovered), remainder grain refiner, Al and incidental impurities.

SUMMARY OF THE INVENTION

It is, therefore, an object of the present invention to provide a new aluminum alloy.

It is a further object of the invention to provide a new aluminum alloy suitable for use in a piston in an internal combustion engine.

It is yet a further object of the invention to provide a new aluminum alloy suitable for high temperature applications such as in internal combustion engines.

And yet another object of the invention is to provide a new aluminum alloy suitable for a forged piston.

Still yet it is another object of the invention to provide a new aluminum alloy suitable for a cast piston.

This as well as other objects of the invention will become apparent from a reading of the specification and an inspection of the claims appended thereto. Thus, an aluminum alloy suitable for high temperature applications is comprised of at least 9.0 wt. % Si, 3.0 to 7.0 wt. % Ni, 1.0 to 6.0 wt. % Cu, at least one of the elements selected from Mg, Mn, V, Sc, Fe, Ti, Sr, Zn, B and Cr, the remainder aluminum and impurities.

DETAILED DESCRIPTION OF THE PREFERRED EMBODIMENTS

The alloy of the present invention can contain at least 9.0 wt. % Si, 3.0 to 7.0 wt. % Ni, 1.5 to 6.0 wt. % Cu, at least one of the elements selected from Mg, Mn, V, Sc, Fe, Ti, Sr, Zn, B and Cr, the remainder aluminum, incidental elements and impurities. Impurities are preferably limited to about 0.05 wt. % each, and the combinations of impurities should not exceed 0.35 wt. %.

A preferred alloy in accordance with the invention can contain 9.0 to 14.0, preferably 9.0 to 13.0 wt. % Si, 3.0 to 6.0 wt. % Ni, 1.5 to 5.0 wt. %, preferably 3.0 to 5.0 wt. %, Cu, 0.8 wt. %, preferably 0.5 wt. % max. Mg, 1.0 wt. % max. Mn, 0.3 wt. % max. V. Selected addition of Sc, Fe, Ti, Sr, Zn, B and Cr can be made to the alloy. For example, these elements can be added as follows: up to 0.3 wt. % Sc, up to 0.3 wt. %, preferably 0.1 wt. % max. Sr, up to 0.2 wt. % B and Cr, max. 0.6 wt. % Fe, 0.25 wt. % max. Ti and 0.5 wt. % max. Zn.

A typical alloy can contain 10 to 11 wt. % Si, 4 to 6 wt. % Ni, 2 to 5 wt. % Cu, 0.1 to 0.8 wt. % Mg, 0.05 to 0.2 wt. % Mn, 0.01 to 0.1 wt. % V, optionally, 0.05 to 0.1 wt. % Sc, 0.05 to 0.8 wt. % Fe, 0.03 to 0.12 wt. % Ti, 0.005 to 0.05 wt. % Sr, 0.05 to 0.2 wt. % Zn, 0.1 wt. % max. B and 0.20 wt. % max. Cr.

Mg contributes to high strength at elevated temperature as compared to similar compositions without Mg. Ni leads to the formation of nickel-aluminide and also contributes to high temperature strength. The metastable form $Al_3Ni_2$ occurs first, and after 1000 hours at 650° and 700° F., stable $Al_3Ni$ begins to form.

Mn, V, Sc, B, Cr and Ti are provided as grain refiners. Mn and the others are added to provide additional grain refining in this particular alloy. Sc, when used, has the effect of providing some grain refining but has the capability of providing precipitate at higher temperatures, thus contributing to the strength of the alloy in high temperature applications. That is, Sc requires high temperature aging to form precipitates. Thus, it is effective as a strengthener in this type of alloy. Sr modifies and refines Si particles to increase ductility and provide for better properties. Zn and Mg provide for strength at low temperature application. However, it is important that the amount of Mg be kept relatively low to avoid hot cracking during ingot casting and because at high temperatures it has the effect of forming larger particles which are detrimental to properties. Fe also is controlled and is present to aid in casting of ingot. B is typically present in conjunction with Ti, particularly where the alloy has been manufactured using Ti-B master alloy.

The presence of Fe, Ni and Cu provides AlFeNiCu or AlFeNi secondary phase which is highly stable and also contributes to elevated temperature strength.

The alloy of the invention is marked by an ability to perform in cast form at high temperature. However, best properties are obtained in the forged and heat treated condition. One application is cast or forged pistons for internal combustion engines, especially high specific output engines, where engine operating temperatures are higher than usual.

Other applications for the alloy can be engine blocks, cylinder heads, compressor bodies and any others where service under high temperature is specified. The alloy can give particularly good service in high temperature diesel engines.

The alloy can be heat treated for use from the "as cast" and worked or forged condition. For example, a T5 temper can be achieved by heating the "as cast" product for 6 to 12 hours in the range 400° to 500° F.; a preferred T5 temper is achieved by subjecting the "as cast" product to 425° to 475° F. for 7 to 10 hours. Hardness in the T5 condition at room temperature is approximately 66–67 $R_B$, which is equivalent to approximately 120 BHN.

The alloy of the invention, besides being a casting alloy, is also suitable for use in powder form for powder metallurgy applications. Thus, it will be seen that the alloy in accordance with the invention has the benefit of providing improved elevated temperature strengths while retaining wear resistance and satisfactory castability and workability. Further, stable dispersoid strengthening from Sc and Ni provides for improved fatigue resistance as well as strength. The alloy of the invention has the advantage of providing improved strength at temperature in the range of 500° to 600° F. and yet is sufficiently extrudable and forgeable for use in forged pistons without hot tearing.

As well as providing the alloy with controlled amounts of alloying elements as described hereinabove, it is preferred that the alloy be prepared according to specific method steps in order to provide the most desirable characteristics. Thus, the alloy described herein can be provided as an ingot or billet for fabrication into a suitable wrought product by techniques currently employed in the art, with continuous casting being preferred. The cast ingot may be preliminarily worked or shaped to provide suitable stock for subsequent working operations. Prior to the principal working operations, the alloy stock is preferably subjected to homogenization, and preferably at metal temperatures of about 700° to 1000° F. for a time period of at least one hour in order to dissolve magnesium and silicon or other soluble elements, and homogenize the internal structure of the metal. A preferred time period is 2 hours or more in the homogenization temperature range. Normally, the heat up and homogenizing treatment does not have to extend for more than 24 hours; however, longer times are not normally detrimental. A time of 3 to 12 hours at the homogenization temperature has been found to be quite suitable.

After the homogenizing treatment, the metal can be rolled or extruded or otherwise subjected to working operations to produce stock such as flat rolled products or extrusions or other stock suitable for shaping into the end product.

To produce extrusion suitable for forging into pistons, for example, the billet is preferably heated to between 700° and 950° F. and extruding started in this temperature range. Typical extrusion rates can be 9 to 12 feet per minute. The extrusion is then sectioned and forged into pistons. For forging purposes, the extrusion may be heated to 600° to 950° F., preferably 750° to 850° F. Thereafter, the forged product is solution heat treated, quenched and aged. Solution heat treatment may be performed in the temperature range of 900° to 1000° F., preferably 950° to 995° F. Thereafter, the product may be rapidly cooled, e.g., water quenched. Aging may be natural but preferably is artificial aging which may be accomplished in several steps or may be accomplished in a single step by subjecting the product to 150° to 550° F., preferably 300° to 400° F. for at least 3 hours and typically 10 to 30 hours. For Sc-containing alloys, the aging temperature can be 500° to 790° F., typically 500° to 700° F. The products may be machined to suitable dimensions.

An alloy having the composition by weight percent: 12.4 Si, 0.41 Fe, 1.9 Cu, 0.06 Mn, 0.02 Mg, 3.8 Ni, 0.13 Cr, 0.11 Ti and 0.03 Sr was cast into an ingot. The ingot was machined to remove some surface porosity and was heated to about 800° F. prior to extrusion. The ingot was extruded to a 4.16 inch diameter starting at about 800° F. The extruded alloy was forged into pistons which were solution heat treated at 968° F. and aged for 10 hours at 375° F. to a T6 temper. The mechanical properties for the pistons of the alloy in accordance with the invention in the T6 condition are provided in the following table:

TABLE

| | Room Temperature | | | | At 600° F. (after 100 h exposure) | | | |
|---|---|---|---|---|---|---|---|---|
| | YS | TS | % El | (% RA) | YS | TS | % El | (% RA) |
| AA4032 | 45.8 | 52.2 | 4.8 | (10) | 5.9 | 7.4 | 34.3 | (67.8) |
| Piston Alloy | 20.6 | 39.0 | 6.0 | (7.9) | 6.5 | 8.4 | 27.0 | (50.9) |

Also provided for comparison purposes are typical mechanical properties of AA4032 in the T6 condition used for pistons. It will be noted that the alloy in accordance with the invention can provide for a significant increase in yield strength and tensile strength at 600° F.

Having thus described the invention, what is claimed is:

1. In the manufacture of a combustion engine component wherein said component is made from an aluminum alloy, the improvement wherein said alloy is provided as an alloy consisting essentially of 9.0 to less than 14 wt. % Si, 3.0 to 7.0 wt. % Ni, 1.5 to 6.0 wt. % Cu, 0.005 to 0.3 wt. % Sr, at least one of the elements selected from Mg, Mn, V, Sc, Fe, Ti, Zn, B and Cr, said elements having the ranges: 0.8 wt. % Mg max., 1 wt. % Mn Max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

2. The alloy in accordance with claim 1 wherein Si is in the range of 9.0 to 13.0 wt. %.

3. The alloy in accordance with claim 1 wherein Ni is in the range of 3.0 to 6.0 wt. %.

4. The alloy in accordance with claim 1 wherein Cu is in the range of 3.0 to 5.0 wt. %.

5. The alloy in accordance with claim 1 wherein Mg is 0.1 to 0.8 wt %.

6. The alloy in accordance with claim 1 wherein Mn is 0.05 to 0.2 wt. %.

7. The alloy in accordance with claim 1 wherein V is 0.01 to 0.1 wt %.

8. The alloy in accordance with claim 1 wherein Sc is 0.05 to 0.1 wt. %.

9. The alloy in accordance with claim 1 wherein Fe is 0.05 to 0.8 wt. %.

10. The alloy in accordance with claim 1 wherein Ti is 0.03 to 0.12 wt. %.

11. The alloy in accordance with claim 1 wherein Sr is 0.1 wt. % max.

12. The alloy in accordance with claim I wherein Zn is 0.05 to 0.2 wt. %.

13. The alloy in accordance with claim 1 wherein B is 0.1 wt. % max.

14. In the manufacture of a combustion engine component wherein said component is made from an aluminum alloy, the improvement wherein said alloy is provided as an alloy consisting essentially of 9.0 to 13.0 wt. % Si, 3.0 to 6.0 wt. % Ni, 3.0 to 5.0 wt. % Cu, 0.005 to 0.3 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt.

% Zn max. and 0.8 wt. % Fe max, the remainder aluminum and impurities.

15. A piston made from an aluminum alloy consisting essentially of 9.0 to less than 14 wt. % Si, 3.0 to 7.0 wt. % Ni, 1.5 to 6.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

16. The piston in accordance with claim 15 wherein Si is in the range of 9.0 to 13.0 wt. %.

17. The piston in accordance with claim 15 wherein Ni is in the range of 3.0 to 6.0 wt. %.

18. The piston in accordance with claim 15 wherein Cu is in the range of 3.0 to 5.0 wt. %.

19. The piston in accordance with claim 15 wherein Mg is 0.1 to 0.8 wt. %.

20. The piston in accordance with claim 15 wherein Mn is 0.05 to 0.2 wt. %.

21. The piston in accordance with claim 15 wherein V is 0.01 to 0.1 wt. %.

22. The piston in accordance with claim 15 wherein Sc is 0.05 to 0.1 wt. %.

23. The piston in accordance with claim 15 wherein Fe is 0.05 to 0.8 wt. %.

24. The piston in accordance with claim 15 wherein Ti is 0.03 to 0.12 wt. %.

25. The alloy in accordance with claim 15 wherein Zn is 0.05 to 0.2 wt. %.

26. The alloy in accordance with claim 15 wherein B is 0.1 wt. % max.

27. A piston made from an aluminum alloy consisting essentially of 9.0 to 13.0 wt. % Si, 3.0 to 6.0 wt. % Ni, 3.0 to 5.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

28. In an internal combustion engine, a piston made from an alloy consisting essentially of 9.0 to less than 14 wt. % Si, 3.0 to 7.0 wt. % Ni, 1.5 to 6.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

29. An internal combustion engine in accordance with claim 28 wherein Si is in the range of 9.0 to 13.0 wt. %.

30. An internal combustion engine in accordance with claim 28 wherein Ni is in the range of 3.0 to 6.0 wt. %.

31. An internal combustion engine in accordance with claim 28 wherein Cu is in the range of 3.0 to 5.0 wt. %.

32. In an internal combustion engine, a piston made from an aluminum alloy consisting essentially of 9.0 to 13.0 wt. % Si, 3.0 to 6.0 wt. % Ni, 3.0 to 5.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

33. A piston in accordance with claim 15 wherein the piston is forged.

34. A piston in accordance with claim 15 wherein the piston is cast.

35. In the manufacture of an engine component having a reciprocating piston therein wherein said component is made from an aluminum alloy, the improvement wherein said alloy is provided as an alloy consisting essentially of 9.0 to less than 14 wt. % Si, 3.0 to 7.0 wt. % Ni, 1.5 to 5.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

36. An aluminum alloy product suitable for high temperature applications consisting essentially of 9.0 to 11.0 wt % Si, 3.0 to 6.0 wt. % Ni, 1.5 to 5.0 wt. % Cu, 0.005 to 0.1 wt. % Sr, at least one of the elements selected from Mg, Mn, V, Sc, Fe, Ti, Zn, B and Cr, said elements having the ranges: 0.8 wt. % Mg max., 1 wt. % Mn max., 0.3 wt. % V max., 0.3 wt. % Sc max., 0.25 wt. % Ti max., up to 0.2 wt. % B, up to 0.2 wt. % Cr, 0.5 wt. % Zn max. and 0.8 wt. % Fe max, the remainder aluminum and impurities.

37. An aluminum alloy product in accordance with claim 35 wherein the product is forged.

38. An aluminum alloy product in accordance with claim 35 wherein the product is cast.

39. An aluminum alloy product in accordance with claim 36 wherein the product is forged.

40. An aluminum alloy product in accordance with claim 36 wherein the product is cast.

* * * * *